US008360425B2

(12) United States Patent
Chng et al.

(10) Patent No.: US 8,360,425 B2
(45) Date of Patent: Jan. 29, 2013

(54) DEPINCHING MECHANISM FOR PAPER JAM REMOVAL IN PRINTER

(75) Inventors: Chow-Jin Chng, Singapore (SG); Foo-Yin Theng, Singapore (SG); Cher-Lek Toh, Singapore (SG)

(73) Assignees: Cal-Comp Precision (Singapore) Limited, Singapore (SG); Cal-Comp Electronics & Communications Company Limited, New Taipei (TW)

( * ) Notice: Subject to any disclaimer, the term of this patent is extended or adjusted under 35 U.S.C. 154(b) by 69 days.

(21) Appl. No.: 13/099,376

(22) Filed: May 3, 2011

(65) Prior Publication Data

US 2012/0248688 A1 Oct. 4, 2012

(30) Foreign Application Priority Data

Mar. 31, 2011 (SG) ..... 201102298-5

(51) Int. Cl.
*B65H 5/04* (2006.01)

(52) U.S. Cl. ..... 271/273; 271/258.01; 399/110

(58) Field of Classification Search ..... 271/272–274, 271/258.01; 399/110, 124; 400/647
See application file for complete search history.

(56) References Cited

U.S. PATENT DOCUMENTS

| | | | | |
|---|---|---|---|---|
| 3,576,163 | A * | 4/1971 | Lawson | 271/274 |
| 4,034,976 | A * | 7/1977 | Lundblad | 271/274 |
| 4,186,919 | A * | 2/1980 | Miciukiewicz | 271/274 |
| 4,188,028 | A * | 2/1980 | Miciukiewicz | 271/274 |
| 5,988,903 | A * | 11/1999 | Baitz et al. | 400/634 |
| 6,139,011 | A * | 10/2000 | Huang et al. | 271/274 |
| 7,726,650 | B2 * | 6/2010 | Tu | 271/273 |
| 8,002,278 | B2 * | 8/2011 | Tsao | 271/273 |
| 2008/0191412 | A1 * | 8/2008 | Tu | 271/273 |

* cited by examiner

*Primary Examiner* — Gerald McClain
(74) *Attorney, Agent, or Firm* — Jianq Chyun IP Office

(57) ABSTRACT

A depinching mechanism including a frame, a star wheel assembly, a limiter arm, a rocker arm and a sensor is provided in present invention. Through the depinching mechanism the star wheel assembly is lifted from the first position to the second position when paper jam occurs, and thus depinched the media the user can clear the paper jam. And after that the star wheel assembly is lowered from the second position to the first position. The star wheel assembly remains in the first position in the normal printing process. Since when paper jam occurs the star wheel assembly is lifted by the depinching mechanism, the user can easily and conveniently remove the jammed paper. And thus, the depinching mechanism can facilitate the user to remove jammed paper when paper jam occurs in printer. Thus, the depinching mechanism can be used in printers to solve the paper jamming problems.

6 Claims, 7 Drawing Sheets

DEPINCHING MECHANISM FOR PAPER JAM REMOVAL IN PRINTER

CROSS-REFERENCE TO RELATED APPLICATION

This application claims the priority benefit of Singapore application serial no. 201102298-5, filed on Mar. 31, 2011. The entirety of the above-mentioned patent application is hereby incorporated by reference herein and made a part of this specification.

BACKGROUND OF THE INVENTION

1. Field of the Invention

The present invention generally relates to printers and more particularly to a depinching mechanism which facilitates users to remove the jammed paper in printers.

2. Description of Related Art

Along with the widespread of information products, various information products are developed, and the information products have a general trend of diversity. However, regarding image display methods of a computer, displays and printers are mainly used as image output devices. Wherein, the printers can be approximately categorized into three types of point matrix printers, inkjet printers and laser printers. Taking the laser printer as an example, it has advantages of high printing quality, fast printing speed, and low average cost of consumables, etc., so that the laser printer is one of the popular printers in the market.

However, during a paper picking process of the printer, a phenomenon of paper skew or paper jam is occurred due to a mechanical structure of the printer and differences of paper properties. It is rather inconvenient and time consuming that paper jam occurs during printing or receiving a fax. Usually paper jams when the transferring paper is clamped by the fixing roller and the pressure roller. To correct the problem of paper skew, a paper feeding device of the printer may perform actions to adjust the paper, by which the paper is repeatedly slid to adjust a position thereof or a mechanical structure is used to mitigate the problem of paper skew or paper jam. Generally in this condition, it is necessary to remove the jammed paper by manually from the printer or the fax machine. For removing the jammed paper the cover of the printer or the fax machine has to be opened and the user has to pull out the jammed paper carefully. If the paper tears when removing it from the feeding rollers, the torn pieces of paper may get stuck within the feeding rollers. And if the printer continues working with any torn pieces of paper remain inside the feeding rollers, more paper jams are likely to occur. Hands may also get dirty to remove the jammed paper if the paper is jammed within the paper feeding device. The present invention is directed to solve the encountering problem described above with a very simple mechanism and low manufacturing cost.

SUMMARY OF THE INVENTION

Accordingly, the present invention is directed to a depinching mechanism which facilitates the user to remove paper jam in printers.

The present invention provides a depinching mechanism for releasing jammed paper in a printer to facilitate the user to remove jammed paper. The depinching mechanism includes a frame, a star wheel assembly, a limiter arm, a rocker arm, a lifting device and a sensor. The frame is disposed in the printer. The star wheel assembly is adapted to carry printing papers, disposed within the printer and located upon the frame. The limiter arm is pivoted on the frame and located below the star wheel assembly. The limiter arm is always kept horizontal until being rotated. The rocker arm is located below the limiter arm and one end rotatably fixed on the frame and another end freely attached to the limiter arm. The lifting device is disposed on the frame and located between the star wheel assembly and the rocker arm.

During the normal printing process, the depinching mechanism is in an idle status and when paper jam occurs the depinching mechanism is in a working status. The lifting device gets into a working status from an idle status as soon as the rocker arm engages with the lifting device. In the working status the lifting device lifts the star wheel assembly from a first position to a second position, and lowers the star wheel assembly from the second position to the first position. In the idle status the lifting device stays motionless.

The sensor is disposed on the frame and located between the star wheel assembly and the limiter arm. The sensor is adapted to detect the position of the star wheel assembly. If the firmware of the printer wants to lift up the star wheel assembly, the sensor will tell whether the star wheel assembly is in the first position or not, if yes then the motor of the driving unit of the printer will rotate X number of encoder counts to lift up the star wheel assembly, if not the motor will rotates till the sensor is triggered and then subsequently rotate X number of encoder counts to lift up the star wheel assembly.

The rocker arm is adapted to engage with the lifting device to transmit a torque to the lifting device to drive the lifting device to be in the working status. The limiter arm prevents the rocker arm to engage with the lifting device when the limiter arm is kept horizontal. And the rocker arm engages with the lifting device when the limiter arm is rotated. The rocker arm and the lifting device are disabled as long as the limiter arm is not rotated.

According to an embodiment of the present invention, the lifting device includes a housing, a gear-cam and a plunger. The housing is fixed on the frame. The gear-cam is free to rotate on the housing. The plunger is movably disposed on the frame and located between the gear-cam and the star wheel assembly with one end freely attached to the gear-cam and another end freely attached to the star wheel assembly.

According to an embodiment of the present invention, when the depinching mechanism is in the idle status when the limiter arm is in the horizontal position. The depinching mechanism is in the working status when the limiter arm is rotated and the feed rollers rotate in a reverse direction. The feed rollers rotate in the forward direction during the normal printing process, and the feed rollers rotate in the reversely direction when paper jam occurs.

According to an embodiment of the present invention, the depinching mechanism further includes a trigger arm. The trigger arm is attached onto bottom of a carriage of the printer. The carriage is adapted to carry printing pens which sweep left and right during printing process so that the printing pens can deposit ink over the width of the media of the printer. The trigger arm is adapted to rotate the limiter arm to enable the rocker arm to engage with the lifting device.

According to an embodiment of the present invention, the rocker arm is coupled to a gear of a driving unit of the printer. The driving unit mainly drives feed rollers of the printer. And thus the rocker arm rotates in a direction toward the limiter arm when the feed rollers rotate in the reverse direction. The rocker arm rotates in a direction away from the limiter arm when the feed rollers of the printer rotate in the forward direction. The rocker arm is blocked by the limiter arm and is unable to engage the lifting device when the limiter arm is horizontal. The rocker arm is free to engage the lifting device when the limiter arm is rotated by the trigger arm.

More particular, during normal printing process, the depinching mechanism is in the idle status, and the feed rollers of the printer rotate in a forward direction. Once the firmware of the printer senses a paper jam, it will tell the feed rollers to rotate in a reverse direction and at the meanwhile it will tell the carriage to move to a predetermined position to trigger the trigger arm. And then the depinching mechanism starts to work as follows: The trigger arm slides and pushes down on the slope of the limiter arm and thus the limiter arm rotates clock wise. This action will free the rocker arm to rotate clock wise. And then, the rocker arm engages with the lifting device to transmit a torque to the lifting device. And once the lifting device is engaged with the rocker arm, the gear-cam starts to rotate. Then, the gear-cam lifts the star wheel assembly from the first position to the second position and lowers the star wheel assembly from the second position to the first position by means of the predetermined profile in its outer race of the gear-cam. And the user can easily and conveniently remove the jammed paper while the star wheel assembly is lifted.

After the jammed paper is removed, the firmware will tell the feed rollers to rotate forward. And since the rocker arm is coupled to the gear which drives the feed rollers, the rocker arm will disengage with the lifting device when the feed rollers rotate forward. At the meanwhile, the trigger arm will free the limiter arm from pushing down on it. And the limiter arm rotates back to its original position (horizontal) by its own weight. Then, once the limiter arm is back to its original position, the limiter arm prevents the rocker arm to enable the lifting device. In this way, the depinching mechanism gets into the idle status again and the feed rollers rotate forward and ready for normal printing process.

In view of the above, according to the embodiments of the present invention, through the depinching mechanism, when paper jam occurs, the star wheel assembly is lifted to the second position from the first position and lowered to the first position. The depinching mechanism is in the idle status during normal printing process. And thus, the depinching mechanism can facilitate the user to remove jammed paper when paper jam occurs.

In order to make the above features and advantages of the present invention comprehensible, embodiments are described in detail below with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
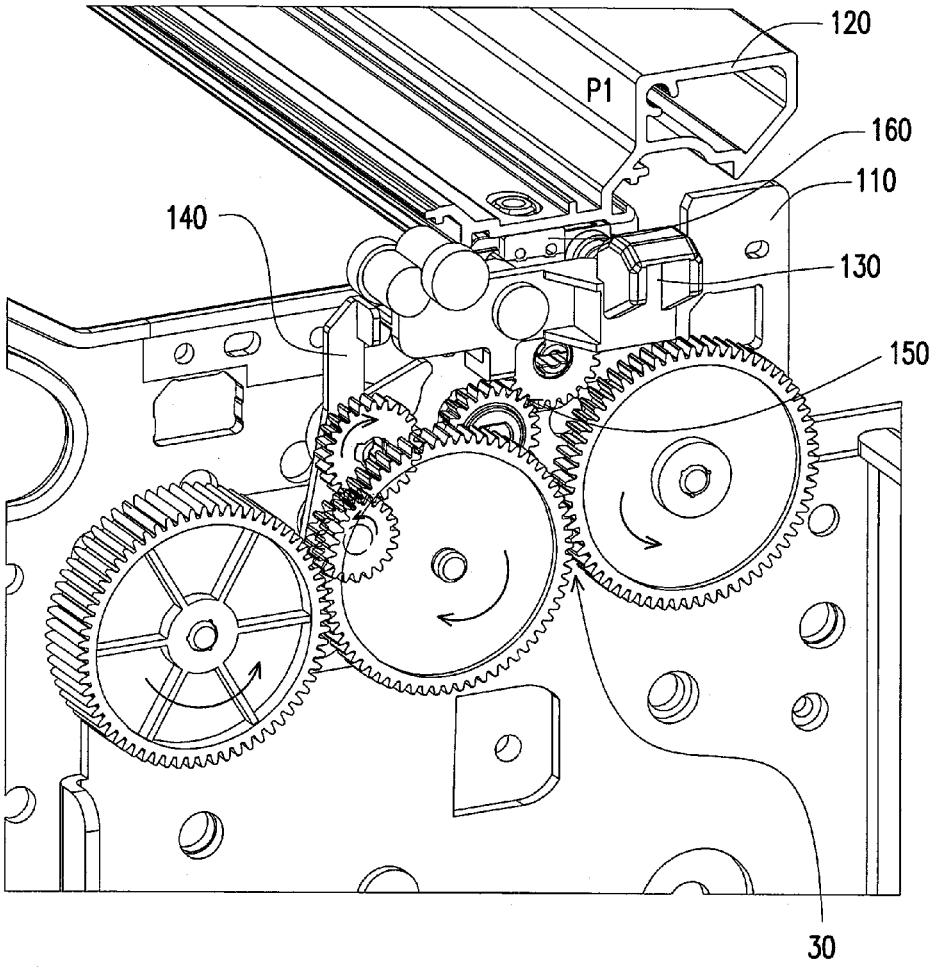
FIG. 1 illustrates a depinching mechanism in an idle status according to an embodiment of present invention.

Reference will now be made in detail to the present preferred embodiments of the invention, examples of which are illustrated in the accompanying drawings. Wherever possible, the same reference numbers are used in the drawings and the description to refer to the same or like parts.

The figures are not drawn to scale and they are provided merely to illustrate the present invention. Several aspects of the invention are described below with reference to example applications for illustration. It should be understood that numerous specific details, relationships and methods are set forth to provide a full understanding of the invention. The present invention may be embodied in many different forms and should not be construed as limited to the embodiments set forth herein. For example, the present invention can be embodied as a method or a system.

The present invention provides a depinching mechanism with a simple mechanism and low manufacturing cost in order to solve the encountering problem of paper jam in printers, in which the depinching mechanism facilitates the user to remove the jammed paper when paper jam occurs during printing process.

Figure 7:
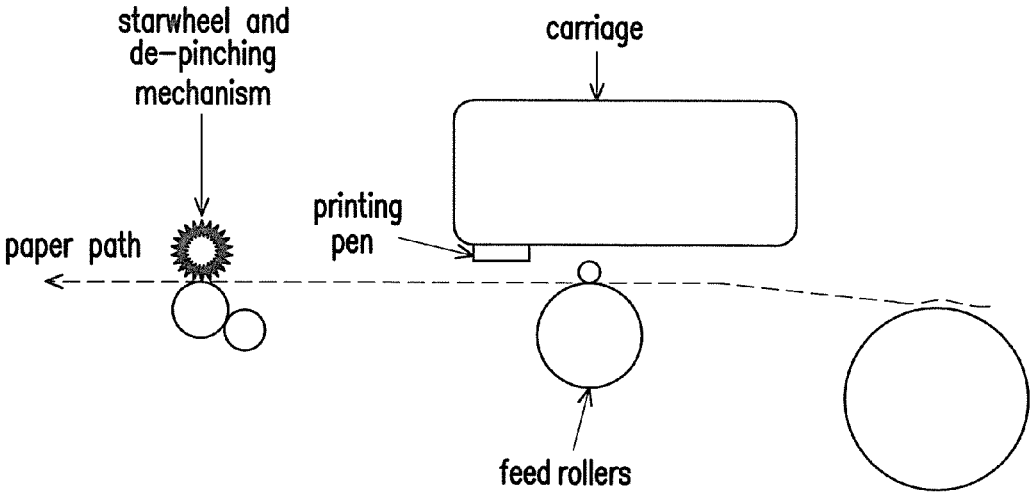
FIG. 7 illustrates the printer according to an embodiment of the present invention.

First, the configuration of the main components of the depinching mechanism according to an embodiment of present invention is going to be described accompanying with figures. FIG. 1 illustrates a depinching mechanism in an idle status according to an embodiment of present invention. FIG. 7 illustrates the printer according to an embodiment of the present invention. Referring to FIG. 1 and FIG. 7, the depinching mechanism 100 for releasing jammed paper in printer including a frame 110, a star wheel assembly 120, a limiter arm 130, a rocker arm 140, a lifting device 150 and a sensor 160. The frame 110 is disposed in the printer. The star wheel assembly 120 is adapted to carry printing papers, disposed within the printer and located upon the frame 110. The limiter arm 130 is pivoted on the frame 110 and located below the star wheel assembly 120. The limiter arm 130 is always kept horizontal until being rotated. The rocker arm 140 is located below the limiter arm 130 and one end rotatably fixed on the frame 110 and another end freely attached to the limiter arm 130. The lifting device 150 is disposed on the frame 110 and located between the star wheel assembly 120 and the rocker arm 140.

Figure 2:
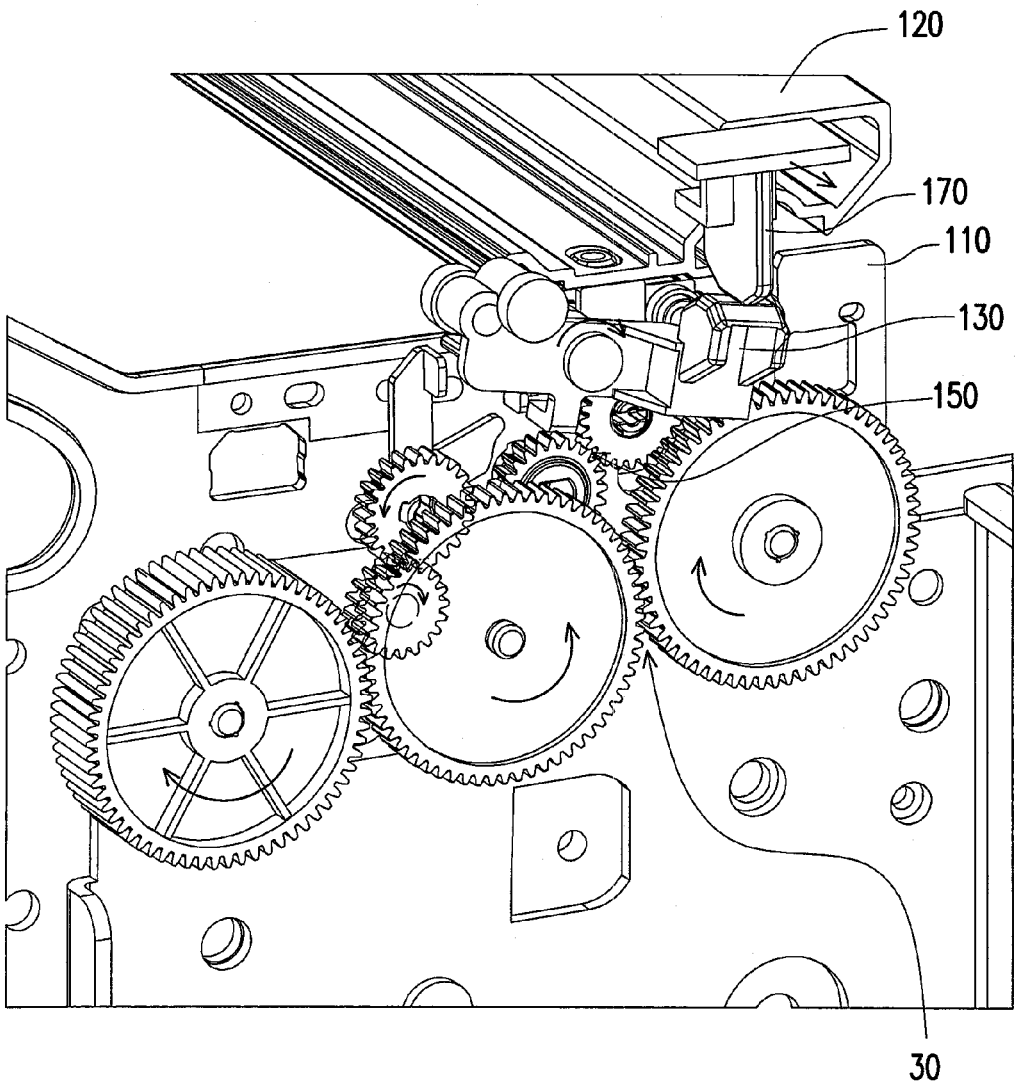
FIG. 2 illustrates the depinching mechanism in FIG. 1 starts to get into the working status.
Figure 3:
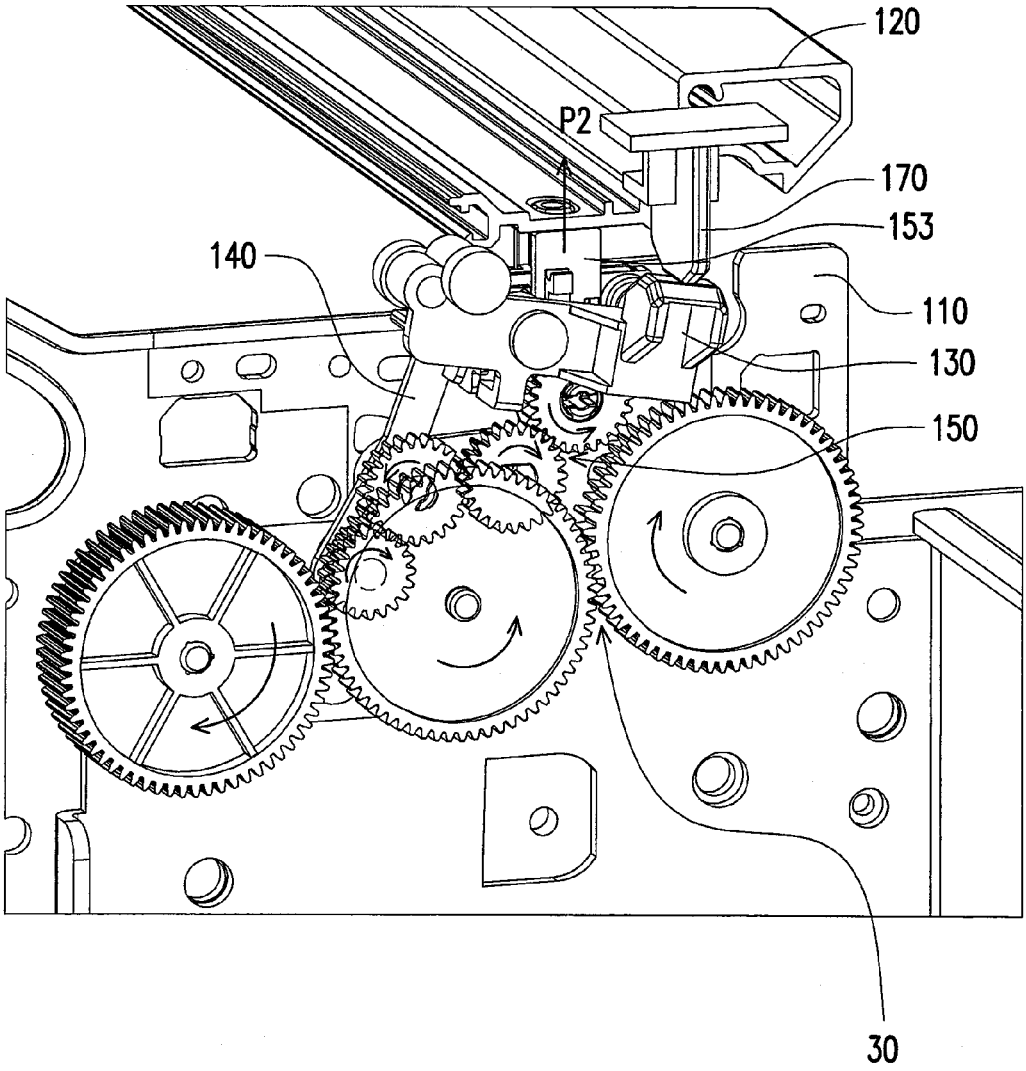
FIG. 3 illustrates the depinching mechanism in FIG. 1 is in the working status, the lifting device is engaged by the rocker arm and the star wheel assembly is lifted to the second position.
Figure 4:
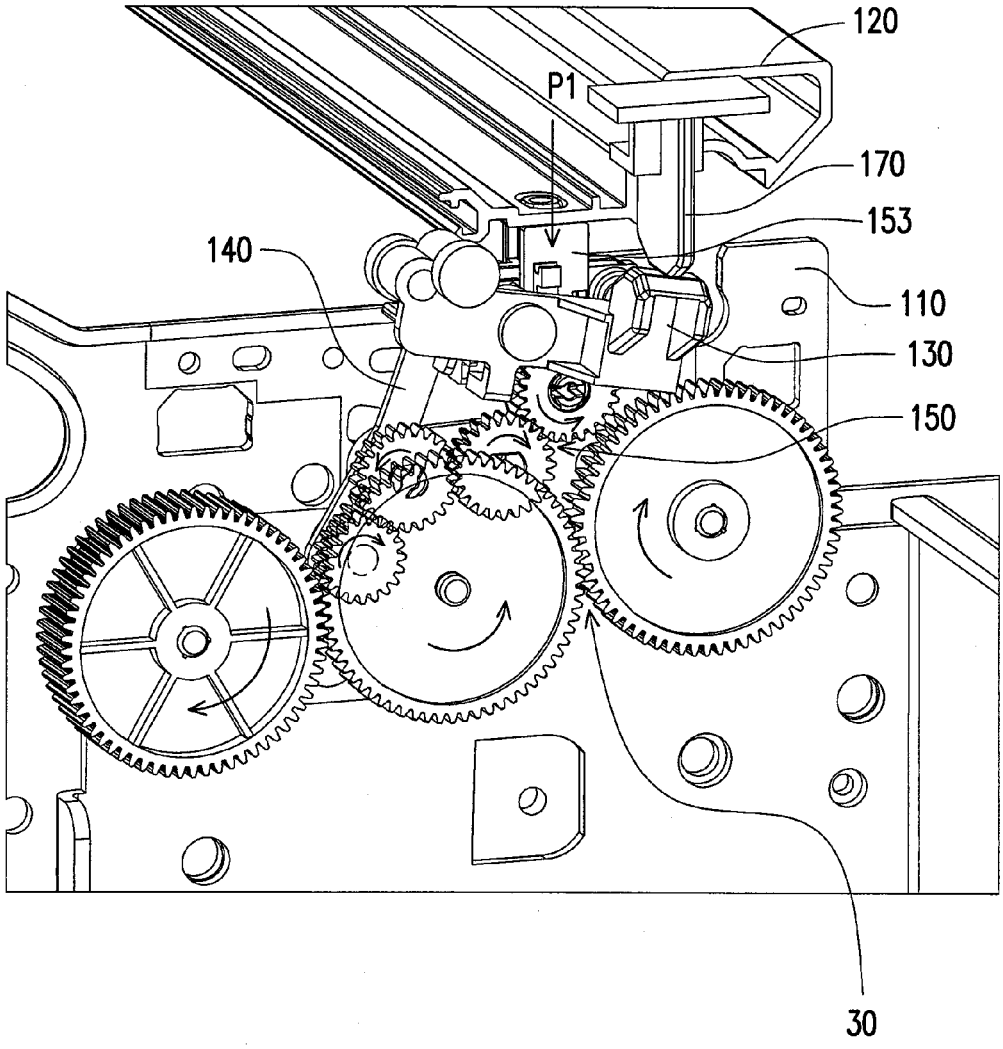
FIG. 4 illustrates the lifting device of the depinching mechanism in FIG. 1 is still in the working status to lower the star wheel assembly to the first position.

After the description of configuration of main components, the depinching mechanism's action is going to be roughly illustrated. FIG. 2 illustrates the depinching mechanism in FIG. 1 starts to get into the working status. FIG. 3 illustrates the depinching mechanism in FIG. 1 is in the working status, the lifting device is engaged by the rocker arm and the star wheel assembly is lifted to the second position. FIG. 4 illustrates the lifting device of the depinching mechanism in FIG. 1 is still in the working status to lower the star wheel assembly to the first position. Please refer to FIG. 1 to FIG. 4. Feed rollers are usually used in printers to feed printing papers. In this embodiment, the depinching mechanism 100 is in the idle status when feed rollers of the printer rotate in a forward direction. The depinching mechanism 100 is in the working status when the feed rollers rotate in a reverse direction. The feed rollers rotate in the forward direction during the normal printing process, and the feed rollers rotate in the reverse direction when paper jam occurs.

In the embodiment, referring to FIG. 1 to FIG. 4, during the normal printing process the depinching mechanism 100 is in an idle status, and the depinching mechanism 100 is in a working status when paper jam occurs. The lifting device 150 gets into a working status from an idle status as soon as the rocker arm 140 engages with the lifting device 150. In the working status the lifting device 150 lifts the star wheel assembly 120 from a first position P1 to a second position P2, and lowers the star wheel assembly 120 from the second position P2 to the first position P1. In the idle status the lifting device 150 stays motionless.

Then, how the rocker arm 140 engages with the lifting device 150 is going to be explained. Please refer to FIG. 1 to FIG. 4 again. The rocker arm 140 is adapted to engage with the lifting device 150 to transmit a torque to the lifting device 150 to drive the lifting device 150 to be in the working status. When there is no paper jammed during the normal printing process, the limiter arm 130 always prevents the rocker arm 140 from engaging with the lifting device 150 since the limiter arm 130 is kept horizontal. The limiter arm 130 is designed with capability of keeping horizontal by its own weight if there is no external force exerts on it. Thus the limiter arm 130 is kept horizontal by its own weight as long as it is not being rotated. And the rocker arm 140 engages with the lifting device 150 when the limiter arm 130 is rotated. The limiter arm 130 will be horizontal again when the printer is back to normal printing process. The rocker arm 140 and the lifting device 150 are disabled as long as the limiter arm 130 is not rotated.

Figure 5:
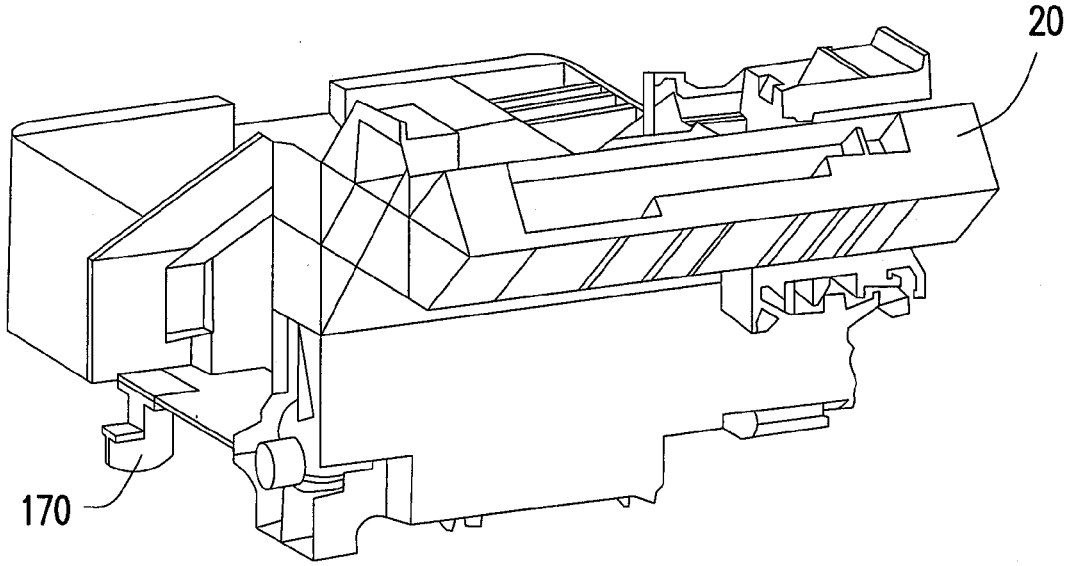
FIG. 5 illustrates the trigger arm of the depinching mechanism in FIG. 1 is disposed at the carriage bottom of the printer.

And then, how the limiter arm 130 is triggered to rotate is going to be described. In the embodiment, the depinching mechanism 100 further includes a trigger arm 170. FIG. 5 illustrates the trigger arm of the depinching mechanism in FIG. 1 is disposed at the carriage bottom of the printer. As shown in FIG. 5, the trigger arm 170 is attached onto bottom of a carriage 20 of the printer. The carriage 20 is adapted to carry printing pens which sweep left and right during printing process so that the printing pens can deposit ink over the width of the media of the printer. As shown in FIG. 2 and FIG. 3, the trigger arm 170 is adapted to rotate the limiter arm 130 to free the rocker arm 140 to engage with the lifting device 150.

Figure 6:
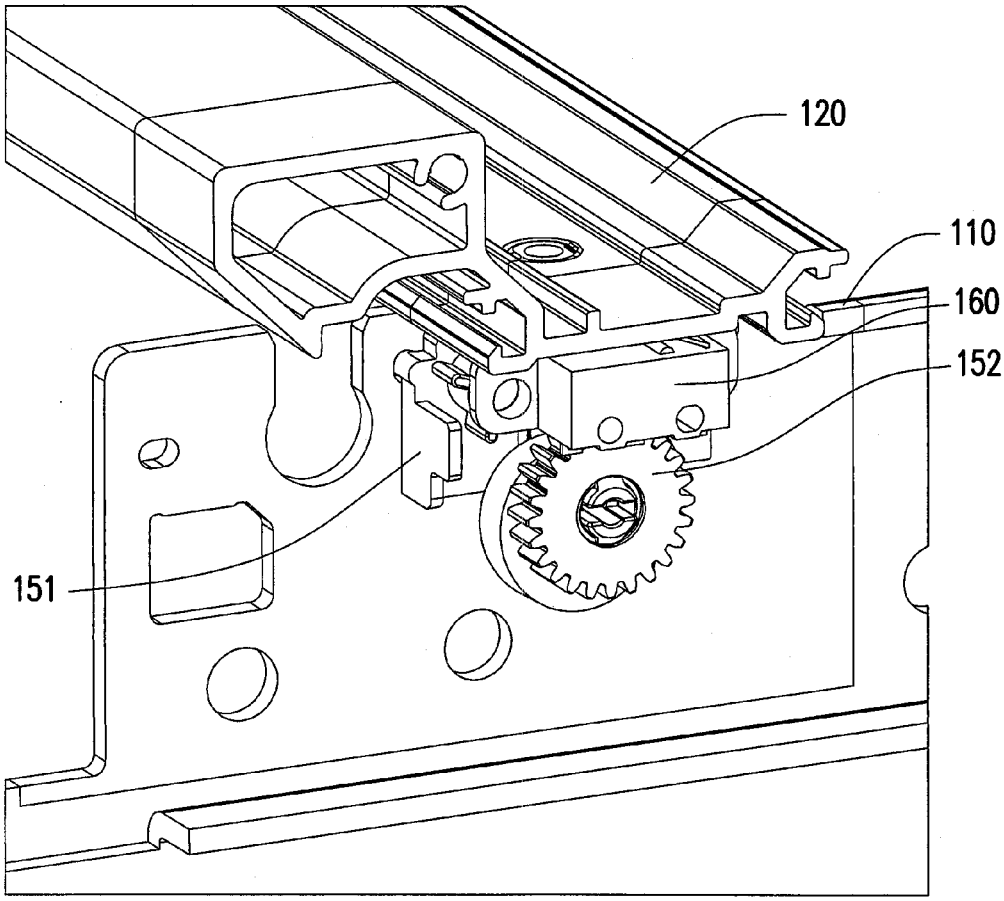
FIG. 6. illustrates the enlarged view of the lifting device of the depinching mechanism in FIG. 1.
Figure 8:
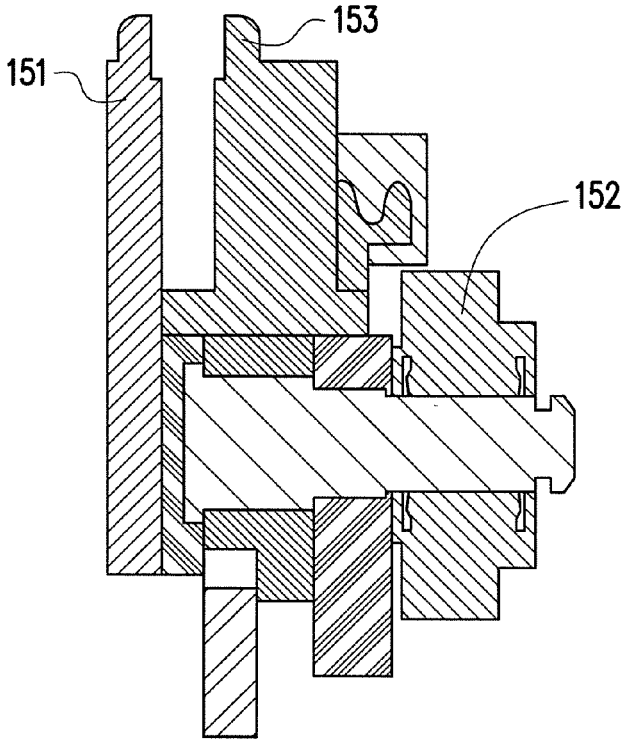
FIG. 8 schematically illustrates a cross section view of the lifting device of the depinching mechanism in FIG. 1.

Furthermore, the details of the lifting device 150 in this embodiment are going to be illustrated accompanying with figures. FIG. 6 illustrates the enlarged view of the lifting device of the depinching mechanism in FIG. 1. FIG. 8 schematically illustrates a cross section view of the lifting device of the depinching mechanism in FIG. 1. Referring to FIG. 6 and FIG. 8, the lifting device 150 includes a housing 151, a gear-cam 152 and a plunger 153. The housing 151 is fixed on the frame. The gear-cam 152 is free to rotate on the housing 151. In this embodiment, the gear-cam 152 may be a spur gear with a cam profile molded at its back or a spur gear and a cam integrally formed. The plunger 153 is movably disposed on the frame 110 and located between the gear-cam 152 and the star wheel assembly 120 with one end freely attached to the gear-cam 152 and another end freely attached to the star wheel assembly 120. In addition, the gear-cam 152 has a predetermined profile on the outer race to push the plunger 153. Therefore, the star wheel assembly 120 is lifted or lowered correspondingly via the predetermined profile of the gear-cam 152. In the embodiment, as shown in FIG. 3, when the lifting device 150 is in the working status, the plunger 153 is pushed by the gear-cam 152 to lift the star wheel assembly 120 up to the second position P2 as the gear-cam 152 rotates from 0 to 180 degree. As shown in FIG. 4, as the gear-cam 152 keeps rotating from 180 to 360 degree, the plunger 153 is lowered together with the star wheel assembly 120 to the first position P1. As shown in FIG. 1, the gear is not engaged and transmitted any load and thus does not work and the star wheel assembly 120 keeps staying in the first position P1 during the normal printing process. The outer predetermined profile of the gear-cam 152 can be designed according to the desired distance which the star wheel assembly 120 has to be lifted up.

In the embodiment, as shown in FIG. 3, the rocker arm 140 is coupled to the driving unit 30 of the printer by means of a gear. The rocker arm 140 is connected with the driving unit 30 through a gear. The rocker arm 140 is further configured a gear to engage with the gear-cam 152 of the lifting device 150. The rocker 140 is driven by driving unit 30 of the feed rollers of the printer. And thus, the rocker arm 140 rotates in a direction toward the limiter arm 130 when the feed rollers rotate in the reverse direction. The rocker arm 140 rotates in a direction away from the limiter arm 130 when the feed rollers of the printer rotate in the forward direction. Thus, the rocker arm 140 attaches to the limiter arm 140 when the limiter arm 140 is horizontal. The rocker arm 140 rotates and engages with the lifting device 150 with the gear engaging to the gear-cam 152 of the lifting device 150 when the limiter arm 130 is rotated by the trigger arm 170.

Finally, the function of sensor configured in this embodiment is illustrated. Referring to FIG. 1, the sensor 160 is disposed on the frame 110 and located between the star wheel assembly 120 and the limiter arm 130. The sensor 160 is required to detect the status or the position of the star wheel assembly 120. For example if the star wheel assembly 120 has to be lifted up, the sensor 160 will tell whether the star wheel assembly 120 is in its lowered position (the first position P1) or not, if yes then the motor of the driving unit 30 will rotate X number of encoder counts to lift the star wheel assembly 120 up, if not the motor will rotate till the sensor 160 is triggered and then subsequently rotate X number of encoder counts to lift the star wheel assembly 120 up. In other words, the function of the sensor 160 is to zero the position of the star wheel assembly 120 when paper jam occurs and the lifting device 150 starts to be in the working status. Such configuration has the advantage of ensuring the position of the star wheel assembly 120.

More particular, in this embodiment, during normal printing process, the depinching mechanism 100 is in the idle status, and the feed rollers of the printer rotate in a forward direction. Once the firmware of the printer senses a paper jam, it will tell the feed rollers to rotate in a reverse direction and at the meanwhile it will tell the carriage 20 to move to a predetermined position to trigger the trigger arm 170. And then the depinching mechanism 100 starts to work as follows: The trigger arm 170 slides and pushes down on the slope of the limiter arm 130 and thus the limiter arm 130 rotates clock wise in this embodiment. This action will free the rocker arm 140 to rotate clock wise. And then, the rocker arm 140 engages with the lifting device 156 to transmit a torque to the lifting device 150. And once the lifting device 150 is engaged with the rocker arm 140, the gear-cam 152 starts to rotate. Then, the plunger 153 lifts the star wheel assembly 120 from the first position P1 to the second position P2 and lowers the star wheel assembly 120 from the second position P2 to the first position P1 by means of the predetermined profile of the gear-cam 152 in its outer race. And the user can easily and conveniently remove the jammed paper while the star wheel assembly 120 is lifted.

After the jammed paper is removed, the firmware will tell the feed rollers to rotate forward. And since the rocker arm 140 is coupled to the gear which drives the feed rollers, the rocker arm 140 will disengage with the lifting device 150 when the feed rollers rotate forward. At the meanwhile, the trigger arm 170 will free the limiter arm 130 from pushing down on it. And the limiter arm 130 rotates back to its original position (horizontal) by its own weight. Then, once the limiter arm 130 is back to its original position, the limiter arm 130 prevents the rocker arm 140 to enable the lifting device 150. In this way, the depinching mechanism 100 gets into the idle status again and the feed rollers rotate forward and ready for the normal printing.

In view of the above, according to the embodiments of the present invention, through the depinching mechanism, when paper jam occurs, the star wheel assembly is lifted to the second position from the first position and lowered to the first position. The depinching mechanism is in the idle status during normal printing process. Since the star wheel assembly is lifted by the depinching mechanism, the user can easily and conveniently remove the jammed paper. And thus, the depinching mechanism can facilitate the user to remove jammed paper when paper jam occurs.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A depinching mechanism, for paper jam removal in printer, comprising:

a frame;

a star wheel assembly, disposed in the printer and located upon the frame;

a limiter arm, pivoted on the frame and located below the star wheel assembly, wherein the limiter arm is kept horizontal by its own weight until being rotated;

a rocker arm, located below the limiter arm and one end rotatably fixed on the frame and another end freely contacts the limiter arm;

a lifting device, disposed on the frame and located between the star wheel assembly and the rocker arm, wherein the lifting device gets into a working status from an idle status as soon as the rocker arm engages with the lifting device, in the working status the lifting device lifts the star wheel assembly from a first position to a second position, and lowers the star wheel assembly from the second position to the first position, in the idle status the lifting device stays motionless; and a sensor, disposed on the frame and located between the star wheel assembly and the limiter arm, wherein the sensor is adapted to detect the position of the star wheel assembly;

wherein the rocker arm and the lifting device are disengaged as long as the limiter arm is not rotated, and once the limiter arm is triggered to rotate, the rocker arm engages with the lifting device to transmit a torque to the lifting device to drive the lifting device to be in the working status, otherwise the limiter arm is kept horizontal and prevents the rocker arm to engage with the lifting device;

wherein the lifting device comprises:

a housing, fixed on the frame;

a gear-cam, rotatably fixed on the housing; and a plunger, movably disposed on the frame and located between the gear-cam and the star wheel assembly with one end freely attached to the gear-cam and another end freely attached to the star wheel assembly.

2. The depinching mechanism according to claim 1, wherein the star wheel assembly is adapted to carry printing papers and the carriage of the printer is adapted to carry printing pens.

3. The depinching mechanism according to claim 1, wherein the depinching mechanism is in the idle status when the limiter arm is horizontal, and the depinching mechanism is in the working status when the limiter arm is rotated and feed rollers rotate in a reverse direction.

4. The depinching mechanism according to claim 1, further comprising a trigger arm, wherein the trigger arm is attached onto bottom of a carriage of the printer, and the trigger arm is adapted to rotate the limiter arm to enable the rocker arm to engage with the lifting device.

5. The depinching mechanism according to claim 1, wherein the rocker arm is coupled to a driving unit of the printer, the rocker arm rotates in a direction toward the limiter arm when feed rollers of the printer rotate in the reverse direction, the rocker arm rotates in a direction away from the limiter arm when the feed rollers of the printer rotate in the forward direction.

6. The depinching mechanism according to claim 1, wherein the rocker arm is blocked by the limiter arm and is unable to engage the lifting device when the limiter arm is horizontal, and the rocker arm is free to engage the lifting device when the limiter arm is rotated.

* * * * *